US005660551A

United States Patent [19]

Sakurai

[11] Patent Number: 5,660,551

[45] Date of Patent: Aug. 26, 1997

[54] HIGH SPEED TRANSMISSION LINE CONNECTOR

[75] Inventor: Haruo Sakurai, Machida, Japan

[73] Assignee: Minnesota Mining and Manufacturing Company, St. Paul, Minn.

[21] Appl. No.: 298,141

[22] Filed: Aug. 30, 1994

[30] Foreign Application Priority Data

Oct. 20, 1993 [JP] Japan ..... 5-262256

[51] Int. Cl.[6] ..... H01R 13/658

[52] U.S. Cl. ..... 439/108; 439/608

[58] Field of Search ..... 439/108, 607, 439/608

[56] References Cited

U.S. PATENT DOCUMENTS

| | | | |
|---|---|---|---|
| 4,846,727 | 7/1989 | Glover et al. | 439/608 |
| 4,914,062 | 4/1990 | Voltz | 439/608 |
| 4,975,084 | 12/1990 | Fedder et al. | 439/608 |
| 5,104,341 | 4/1992 | Gilissen et al. | 439/79 |
| 5,174,770 | 12/1992 | Sasaki et al. | 439/608 |
| 5,238,414 | 8/1993 | Yaegashi et al. | 439/608 |
| 5,403,206 | 4/1995 | McNamara et al. | 439/108 |

OTHER PUBLICATIONS

The connector family according to DIN 41612, IEC 603-2 and the modular 19" system Steckverbinder fur gedruckte Schaltungen indirektes Stecken, RastermanB 2,54 mm.

*Primary Examiner*—Gary F. Paumen

*Attorney, Agent, or Firm*—Gary L. Griswold; Walter N. Kirn; David W. Anderson

[57] ABSTRACT

The present invention is aimed at a provision of a connector for high speed transmission, in which no or little cross-talk occurs and irregularity of a propagation delay is improved. The connector includes a plurality of ground contacts having a generally L-shaped cross section, and arranged in a regular parallel arrangement. The whole sectional shape of the connector is in the form of a grid. The connector also includes a plurality of contacts for signal transmission, that are located within the grid, so that the signal transmission contacts are substantially surrounded by ground contacts.

5 Claims, 5 Drawing Sheets

HIGH SPEED TRANSMISSION LINE CONNECTOR

BACKGROUND OF THE INVENTION

1. Field of the Invention

A present invention relates to a connector for high speed transmission, and more precisely, it relates to a connector having less cross-talk noise and irregularity of propagation delay.

2. Prior Art

In conventional electronic apparatuses, such as a computer, a DIN connector (e.g., DIN standard 41612) has been used to connect substrates. In the DIN connector, both the ground contact and the signal contact have a rectangular sectional shape and naked or exposed right angle portions, intermediate the connection portions.

For a normal signal transmission there is no disadvantage caused by the conventional DIN connector mentioned above, but if the DIN connector is used for high speed transmission, not only does cross-talk tend to occur, but also there is a considerable irregularity in the propagation delay, etc.

The present invention is designed to restrict this and to provide a high speed transmission connector in which the occurrence of cross-talk is restricted and the irregularity of the propagation delay is minimized.

SUMMARY OF THE INVENTION

To solve the problems mentioned above, according to the present invention, there is provided a connector module including a ground contact and a signal contact, each having an external connecting portion, an intermediate connecting portion and a securing portion to be secured to a substrate, located in this order, characterized in that the intermediate connecting portion of the ground contact is of generally L-shape in cross section, the ground contact and signal contact are cooperatively placed such that the intermediate connecting portion of the signal contact is substantially surrounded by the generally L-shape configuration of the intermediate connecting portion of the ground contact.

According to the present invention, the connector for high speed transmission comprises a plurality of connector modules which are regularly arranged, and the intermediate connecting portion of each of the signal contacts is surrounded by the intermediate connecting portions of the ground contacts so as to be electromagnetically shielded.

Preferably, the external connecting portions of the ground contacts are flat; the flat external connecting portions of the ground contacts come into contact and engagement with the flat connecting portion of an associated connector to exhibit a generally L-shaped intersection when the connector is connected to the associated connector; and, the external connecting portion of each signal contact is surrounded and electromagnetically shielded by the flat external connecting portions of the ground contacts and the flat connecting portion of the associated connector.

Preferably, the intermediate connecting portions constitute a right angle portion embedded into more than one resin and the permittivity of the outer resin that has a longer contact length is smaller than the permittivity of the adjacent inner resin that has a shorter contact length.

Moreover, preferably, the difference in permittivity is not less than 0.5.

Since the signal line is surrounded by the ground line, the signal line is electromagnetically shielded, so that cross-talk is restricted.

If the right angle portion is embedded in resin, the shield capability can be enhanced. Moreover, if the permittivity of the outer resin that has a longer contact length is smaller than that of the inner resin having a short contact length, the irregularity of the propagation delay of the signal can be reduced.

DETAILED DESCRIPTION OF THE PRESENTLY PREFERRED EMBODIMENTS

Figure 1A:
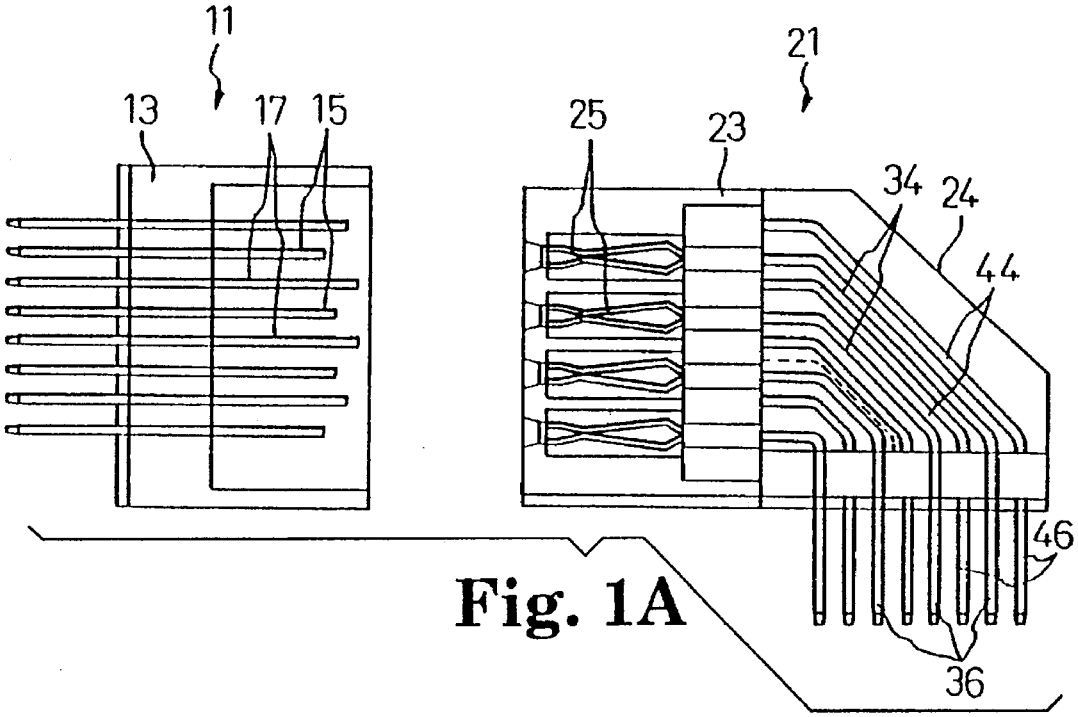
FIG. 1A is a sectional side elevational view of an embodiment of a high speed transmission connector, with the parts separated, according to the present invention.

The invention will be discussed below with reference to embodiments shown in the drawings.

In FIG. 1, a straight type of header connector 11 on a mother board side is comprised of a header housing 13 and angle pins (male contacts) 15 for a signal transmission line and flat pins (male contacts) 17 for a ground line. These pins 15 and 17 are alternately arranged in a plurality of rows on a header housing 13 of the associated connector 11.

A right-angle type of socket connector 21 on a daughter board side is comprised of a receptacle housing 23 and cantilevered contacts 25 for a signal transmission line and tuning fork spaced contacts 27 for a ground line. A plurality of rows of the contacts 25 and 27 are regularly arranged so as to correspond to those of the header connector 11.

Figure 2:
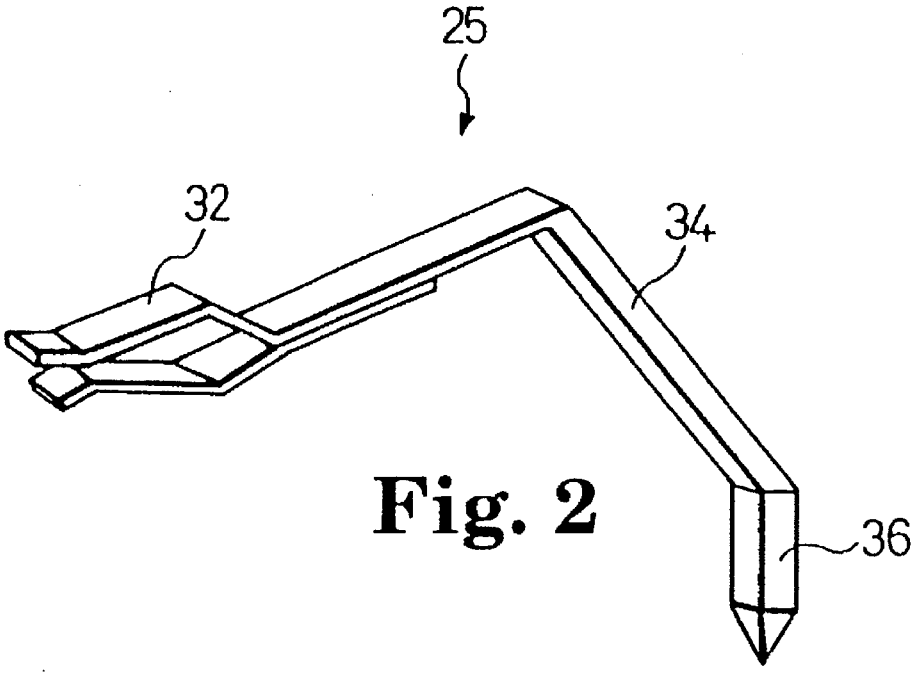
FIG. 2 is a perspective view of a cantilevered contact of a socket connector.

As can be seen in FIG. 2, each of the cantilevered contacts 25 of the socket connector 21 is provided, on the front end thereof, with a bifurcated portion 32 in which the associated angle pins 15 of the header connector 11 can be fitted, on the intermediate portion, with a right angle portion 34 having a square sectional shape, and, on the securing or rear end portion thereof, with a terminal 36, respectively.

Figure 3:
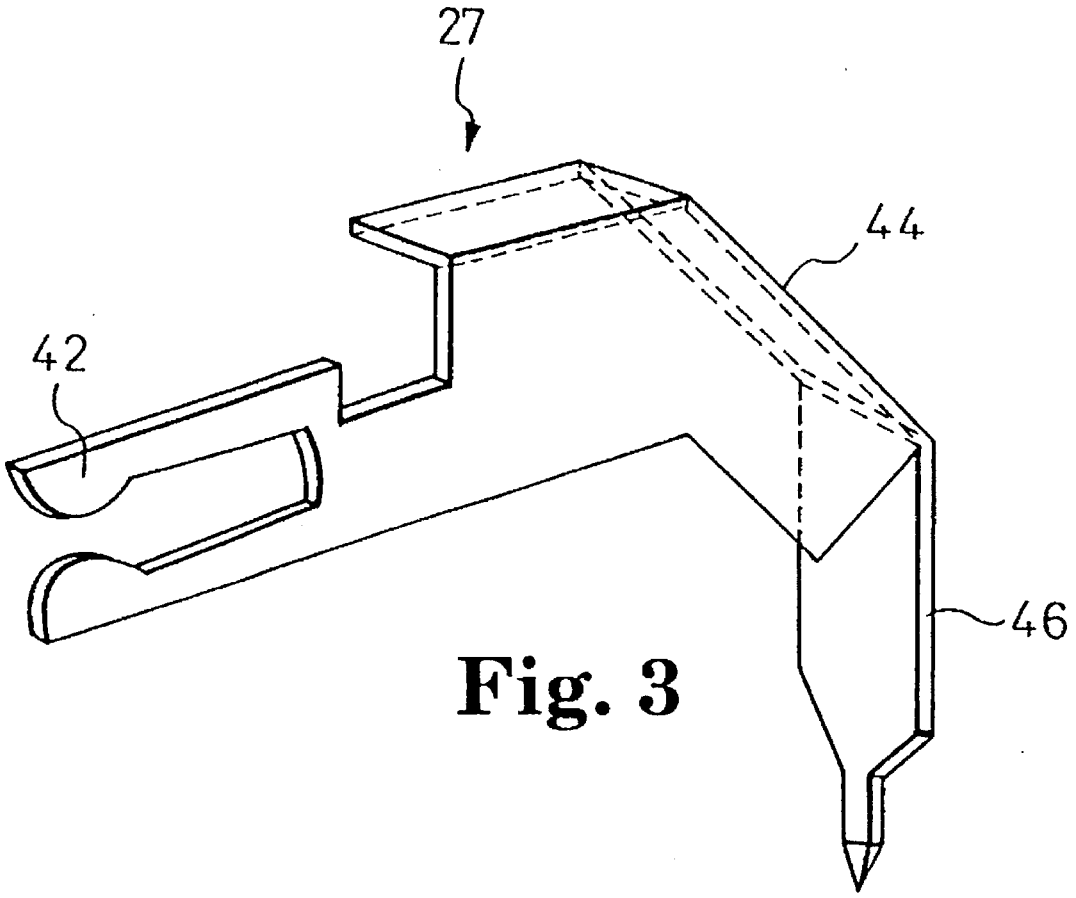
FIG. 3 is a perspective view of a tuning fork shape contact of a socket connector.
Figure 4:
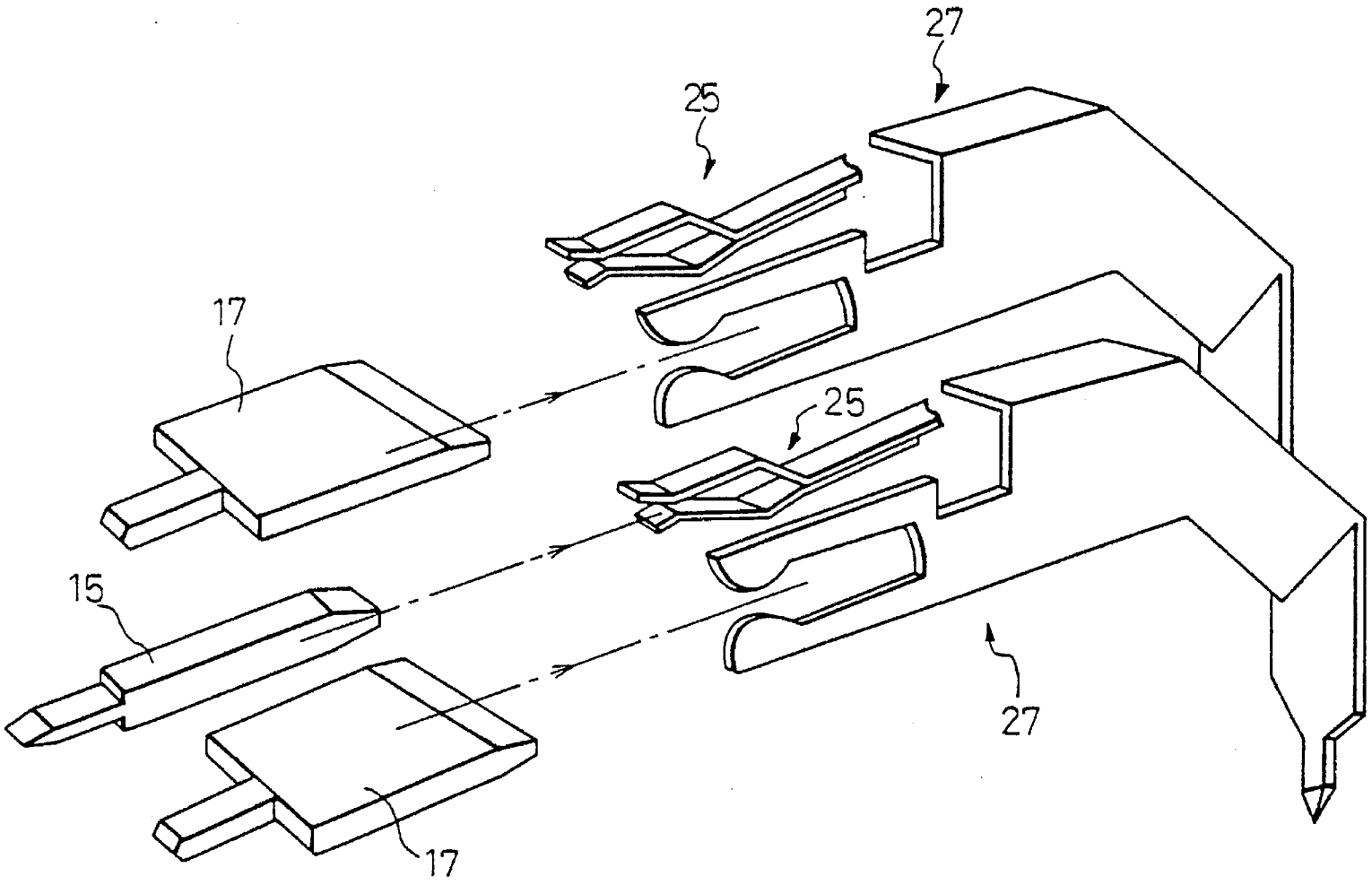
FIG. 4 is a perspective view illustrating the connection of a cantilevered contact of a tuning fork type contact and a flat pin surrounding the connecting portions of the signal contact.

As can be seen from FIG. 3, each of the tuning fork shape contacts 27 of the socket connector 21 is provided, on the front end thereof, with a tuning fork portion 42 in which the associated flat pin 17 of the header connector 11 can be fitted, on the intermediate portion thereof, with an L-shaped right angle portion 44, and a securing rear end thereof, with a terminal 46, respectively.

Figure 1B:
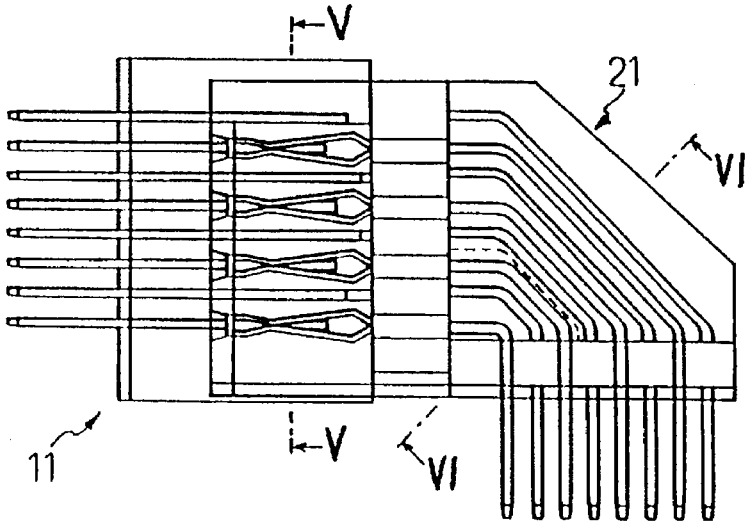
FIG. 1B is a sectional view of the connector of FIG. 1A with the parts assembled.
Figure 5:
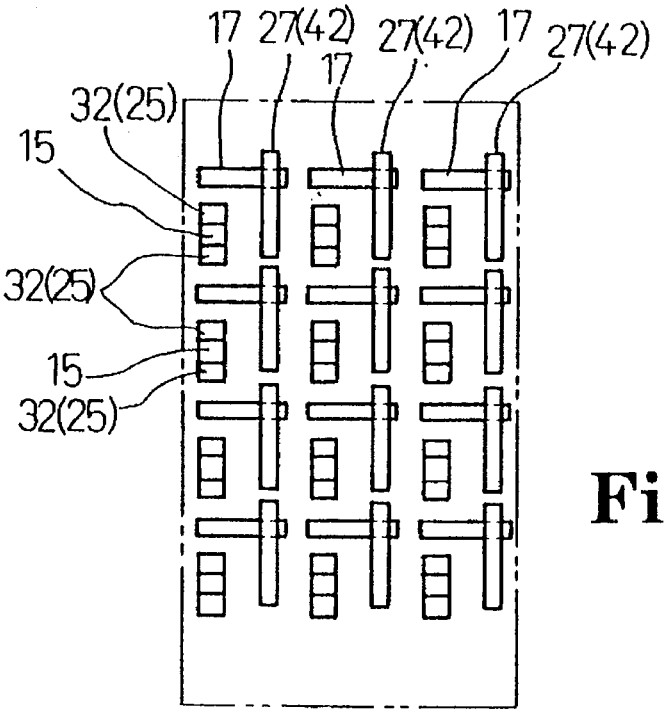
FIG. 5 is a sectional view taken along the line V—V in FIG. 1B.

With reference to FIG. 5 (sectional view), which is taken along the line V—V in FIG. 1B, to show the engagement of the header connector 11 and the socket connector 21, the angle pins 15 are held between and by the bifurcated portions 32 of the corresponding cantilevered contacts 25 to have a rectangular sectional shape. The flat pins 17 are held by and between the tuning fork portions 42 of the associated tuning fork type contact 27 to have an L-cross sectional shape.

Looking at FIG. 5, the angle pins 15 and the bifurcated portion 32 of the cantilevered contacts 25 constitute the signal transmission lines, and other than those on the left most side and bottom side are substantially surrounded by discontinuous rectangular frames (grids) comprised of two parallel flat pins 17 that are spaced from each other and two parallel tuning fork portions 42 of the tuning fork type contacts 27 that are spaced from one another to constitute the ground line. Namely, a coaxial structure in which the signal transmission line is surrounded by the ground line is obtained.

Figure 6:
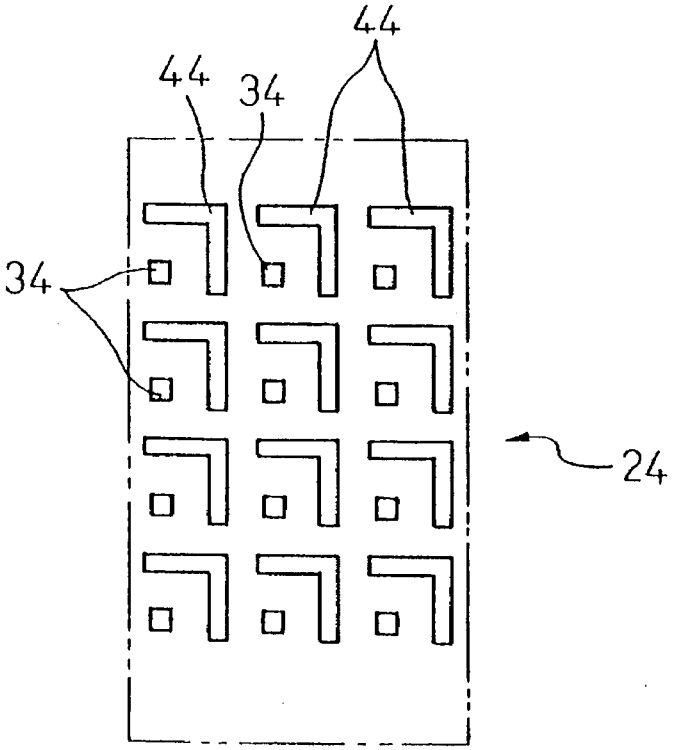
FIG. 6 is a sectional view taken along the line VI—VI in FIG. 1B.

Looking at FIG. 6 (sectional view), taken along the lines VI—VI in FIG. 1B, there is shown the right angle portion 24 of the socket connector 21 and the right angle portions 34 of the square section of the cantilevered contacts 25 which constitute the signal transmission line, other than those on the left most and bottom sides, are substantially surrounded by discontinuous rectangular frames (grids) comprised of the L-shaped right angle portions 44 of the tuning fork shaped contacts 27 which constitute the ground line, respectively. Namely, a coaxial structure in which the signal transmission line 34 is surrounded by the ground line is formed.

As can be understood from the foregoing, according to the illustrated embodiment, since a (pseudo) coaxial structure in which the signal transmission line is surrounded by the ground line is formed, not only the electromagnetic shield efficiency be improved, but also no or little cross-talk takes place.

Figure 8:
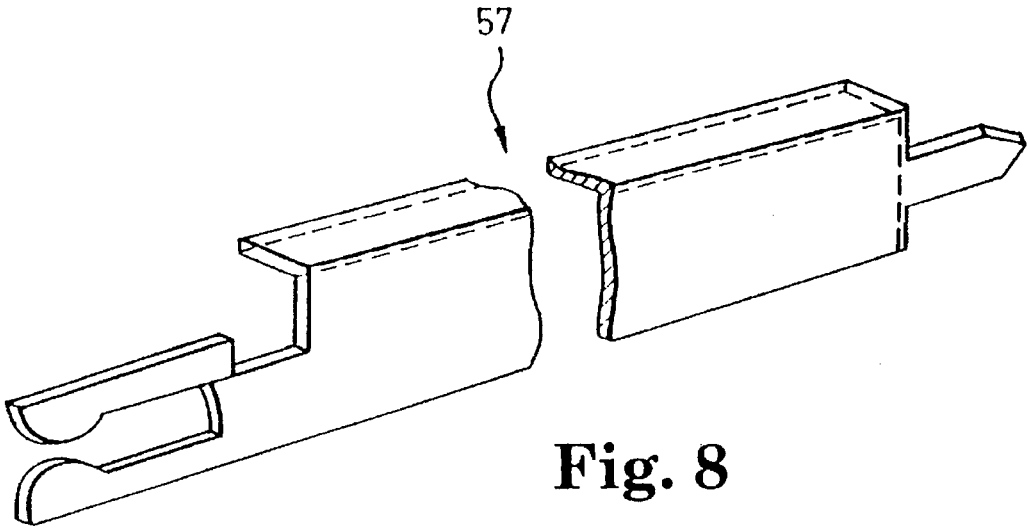
FIG. 8 is a perspective view of a straight type of tuning fork like ground contact according to the present invention.

It should be noted that although the socket connector 21 of the illustrated embodiment is provided with the right angle portion 24, the present invention is not limited thereto. For example, the present invention can be applied to a socket connector (not shown) having a straight type ground contact 57 as shown in FIG. 8 without a right angle portion.

Alternatively, it is possible to provide the right angle portion 24 of the socket connector 21, wherein the tuning fork type contacts 27 for the ground line and the cantilevered contacts 25 for the signal transmission line are embedded in more than one resin layer. Namely, it is preferable to embed the right angle portion in the resin. This is because if the right angle portion is exposed to the atmosphere or naked, there is a large tendency of occurrence of cross-talk inherent to the high speed transmission connector, thus resulting in poor operation of the apparatus. Furthermore, in the high speed transmission connector in which the pitch between the terminals is small and the thickness of the terminals is small, no satisfactory mechanical strength and no moisture proof and anti-corrosion qualities can be expected. The presence of the resin coating solves these problems.

The transmission time (Nsec) and the transmission speed (mm/nsec) are represented by the following:

$$t=L/V$$

$$v=300/\sqrt{\varepsilon}$$

wherein L designates the contact length (mm), v the transmission speed (mm/nsec), and $\varepsilon$ the permittivity (–) of the resin in which the terminals are embedded within a frequency band of 10–100 MHZ, respectively.

Consequently, the transmission time can be determined in accordance with the contact length and the resin permittivity. Namely, to reduce the difference in the transmission time, for example, less that 100 Ps for a high speed transmission connector, it is necessary to change the permittivity of the resin layer in accordance with the contact length of the terminal so that the permittivity of the outer resin layer that has a longer contact length is smaller than that of the inner resin layer having a short contact length, adjacent thereto to thereby correct the deviation of the transmission time.

It was confirmed that when the difference in permittivity of the resin layers is at least above 0.5, a high speed transmission connector in which there is a decreased difference in the transmission time between the terminals, corresponding to a normal contact length (e.g., 5–30 mm) can be obtained. In the present invention, at least two resin layers having different permittivities are used. If the difference in the transmission time is below 100 Ps, more than two resin layers could be used.

In the present invention, there is no limitation to the resins to be used. By way of example, the following resins can be advantageously used.

PET (Polybutylene terephthalate) 3.7

PPS (Polyphenylene sulfide) 4.6

PCT (Polycyclohexane dimethylterephthalate) 2.8

PTFE (Polytetrafluoroethylene) 2.2

* For reference, the permittivity of the air is 1.0.

It is also possible to control the permittivity of the resin by adding an additive or additives. In particular, the addition of an additive to change the permittivity ensures high contact strength of the boundary of two adjacent resin layers.

Furthermore, in a preferred embodiment of a combination of the two resin layers adjacent to each other, PPS and PCT are used as a resin of high permittivity and a resin of a lower permittivity, respectively. The PPS exhibits a relatively high permittivity, heat resistance, moldability, and a mechanical strength, in addition thereto, is inexpensive, and accordingly, can be advantageously used as an embedding resin of the connector. The PCT exhibits a relatively low permittivity and is made of a liquid crystal resin having crystallinity, good heat resistance, and a high mechanical strength, and accordingly, can be advantageously used as an embedding resin for the connector.

Table 1 below shows experimental results in which there were four kinds of connectors prepared, consisting of (a) a connector in which the inner side (I) of the right angle portion 24 is made of PPC (Fortron commercially available from Polyplastics Inc.) of high permittivity and the outer side (II) thereof is made of PPS resin having a low permittivity, higher dielectric property, FIG. 7(*a*); (*b*) a connector in which the entirety of the right angle portion is made of PBT resin which is usually used in a conventional connector, FIG. 7(*b*); (*c*) a connector in which the right angle portion 24 is not made of resin, is free of resin, FIG. 7(*c*); and (*d*) a conventional DIN connector (not shown in FIG. 7).

TABLE 1

| | | Cross-Talk level (%) | Deviation of delay Time |
|---|---|---|---|
| Embodiment | (a) Two resin (I, II) | 0.7 | $35^{PS}$ |
| | (b) Single resin | 0.8 | $120^{PS}$ |
| | (c) No resin | 0.9 | $40^{PS}$ |
| (d) Prior art connector DIN | | 2.2 | $38^{PS}$ |

Figure 7A:
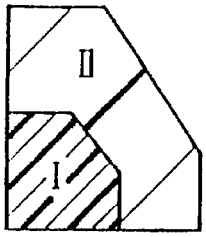
FIGS. 7*a*, 7*b* and 7*c* are a schematic views of different examples of the right angle portion of a socket connector.
Figure 7B:
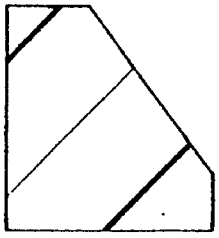
Figure 7C:
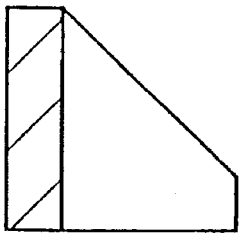

As can be seen from Table 1 above, the connector indicated at (a) in FIG. 7, in which the right angle portion is made of two resin layers remarkably reduces the cross-talk and irregularity of propagation delay, in comparison with the conventional DIN connector. Also the connectors indicated at (b) and (c) in FIG. 7 in which they have a coaxial structure exhibit improved properties of cross-talk and the irregularity of propagation delay, in comparison with the conventional DIN connector.

It should be appreciated that the connector indicated in FIG. 7(*b*) which is made of single resin exhibits rather a worse irregularity of the propagation delay than conventional DIN connector.

Effect of the invention

As can be understood from the above discussion, according to the present invention, a high speed transmission connector in which no or little cross-talk occurs and the irregularity of the propagation delay can be restricted can be realized.

I claim:

1. A connector for high speed transmission comprising a housing, a plurality of connector modules supported by said housing, each connector module comprising a ground contact and a signal contact, each Contact having an external connecting portion, an intermediate portion and a securing portion to be secured to a substrate, said intermediate portion of the ground contact is generally L-shaped in cross section; said intermediate portion of said signal contact is generally rectangular in cross section; said ground contact and signal contact are placed such that the intermediate portion of the signal contact is substantially surrounded by the generally L-shaped shape of the intermediate portion of the ground contacts wherein said intermediate portion of each of the signal contacts is surrounded by the intermediate portions of the ground contacts, except for some peripheral ones of said signal contacts, so as to be electromagnetically shielded; and wherein said external connecting portions of said ground contacts are flat, said flat external connecting portions of said ground contacts come into contact and engage with a flat connecting portion of an associated connector to exhibit a generally L-shape cross-section when the connector is connected to the associated connector; said external connecting portion of each signal contact is surrounded and electromagnetically shielded by said flat external connecting portions of said ground contacts and the flat connecting portion of the associated connector.

2. A connector for high speed transmission according to claim 1, wherein said intermediate portions are angularly related to said external connecting portions and said securing portions to constitute a right angle connector.

3. A connector for high speed transmission according to claim 1, wherein said intermediate portions of said contacts constitute a right angle portion, and said intermediate portions are embedded in a resin.

4. A connector for high speed transmission according to claim 3, wherein said intermediate portions of said contacts are embedded into more than one resin, the permittivity of the outer resin that has contact with a longer length of the intermediate portion of the contacts is smaller than the permittivity of the adjacent inner resin that has contact with a shorter length of the intermediate portion of the contacts.

5. A connector for high speed transmission according to claim 4, wherein the difference in permittivity is not less than 0.5.

* * * * *